United States Patent [19]

Markus et al.

[11] 4,346,854

[45] Aug. 31, 1982

[54] PRINTER PAPER TAKE-UP AND STORAGE DEVICE

[75] Inventors: Lawrence W. Markus, Lake Bluff; George Smejkal, Mt. Prospect; Melvin A. Lace, Prospect Heights, all of Ill.

[73] Assignee: Extel Corporation, Northbrook, Ill.

[21] Appl. No.: 200,603

[22] Filed: Oct. 24, 1980

[51] Int. Cl.[3] ..... B65H 17/02; B65H 25/22; B65H 75/18

[52] U.S. Cl. ..... 242/67.1 R; 242/73; 242/75.5

[58] Field of Search ..... 242/67.1 R, 67.2, 67.3 R, 242/75.5, 75.51, 75.3, 57, 73

[56] References Cited

U.S. PATENT DOCUMENTS

| | | | |
|---|---|---|---|
| 2,977,059 | 3/1961 | Mero | 242/75.5 X |
| 3,025,016 | 3/1962 | De Boo | 242/73 X |
| 3,045,941 | 7/1962 | Keesling | 242/75.5 X |
| 3,385,535 | 5/1968 | Dodsworth | 242/75.5 X |
| 3,782,666 | 1/1974 | Sandrone et al. | 242/67.2 |
| 3,857,527 | 12/1974 | Kranz | 242/67.3 R X |
| 3,934,835 | 1/1976 | Maxwell | 242/67.3 R X |
| 4,061,287 | 12/1977 | Shakespeare | 242/67.1 R |

*Primary Examiner*—John M. Jillions

*Attorney, Agent, or Firm*—Kinzer, Plyer, Dorn & McEachran

[57] ABSTRACT

A paper web take-up and storage device for a teleprinter, having a spring biased guide bail to sense paper length and a control switch that energizes a storage reel drive motor for take-up when needed, is also equipped with a paper sensor arm to detect a no-paper condition; a single switch actuator lever that is aligned with the bail, with the sensor arm, and with the control switch affords complete control for both take-up and no-paper conditions in an arrangement that allows limited reverse movement of the web back toward the printer with no appreciable resistance apart from a relatively weak bail bias spring. The reel includes a spring-latched guide flange adjustable to accommodate a number of different paper widths.

7 Claims, 6 Drawing Figures

Fig. 1.
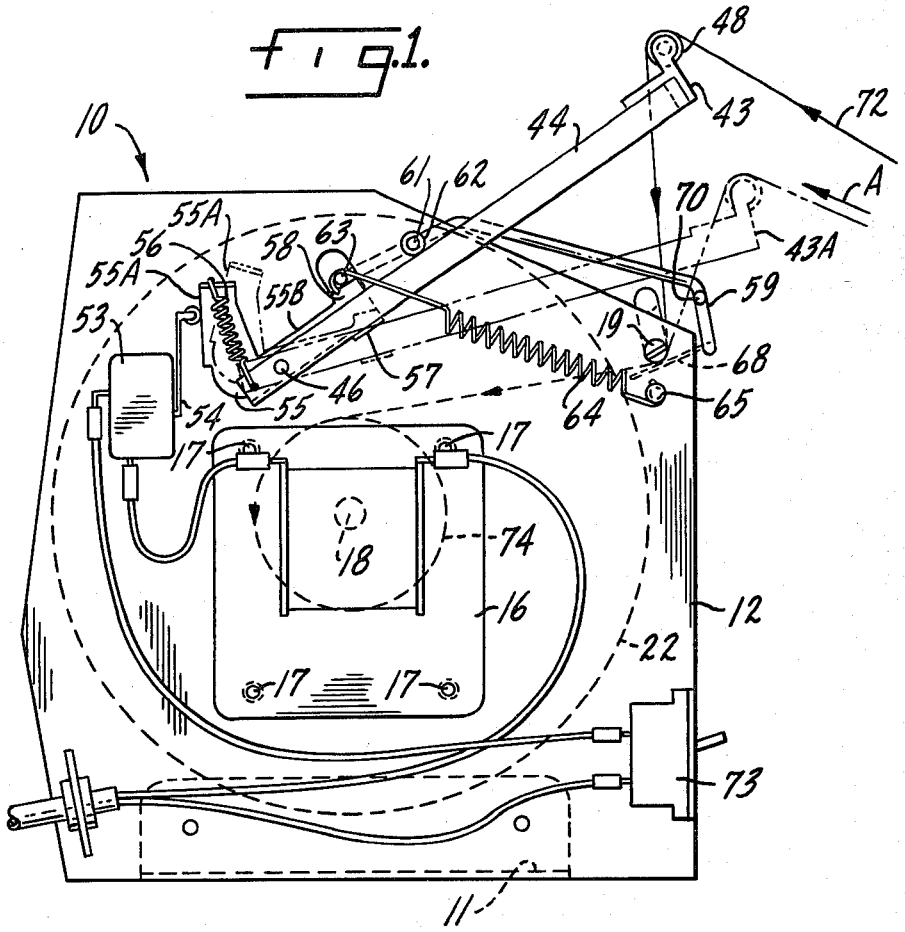
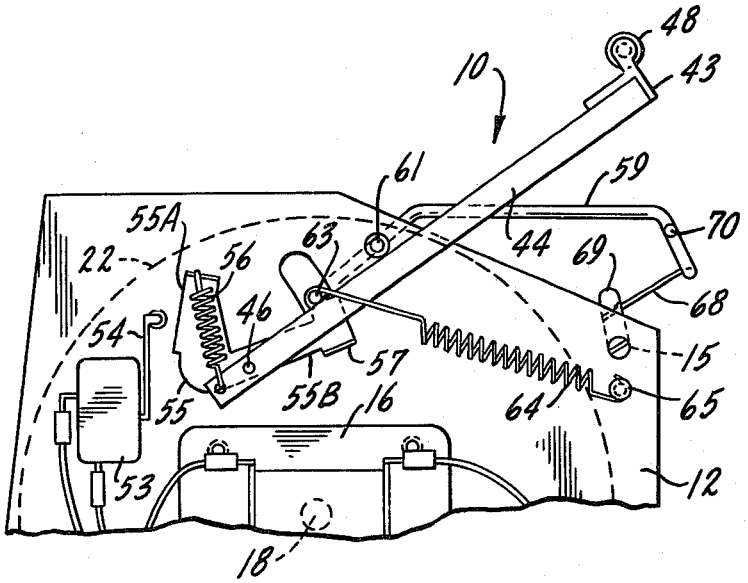
Fig. 2.

PRINTER PAPER TAKE-UP AND STORAGE DEVICE

BACKGROUND OF THE INVENTION

Teleprinters and other printers often record information on an elongated paper web rather than on individual sheets. Usually, in such a printer, the paper is advanced by a short line space increment following printing of each line; more rarely, the web may be advanced continuously during printing. The printer frequently prints two webs simultaneously. In many instances it is desirable to store one paper web in continuous, uncut form for record purposes.

One problem in a printer paper take-up and storage device for a printer that records on a paper web is a tendency toward skewing of the paper web due to imbalance between the forces on the paper traversing the printer and the forces applied to the web by the take-up device. Another problem occurs in printers that provide for last-character visibility by advancing a short length of the web from the printer, and require a corresponding reverse movement of the paper back into the printer to resume printing, as in the printer of Mero et al. U.S. Pat. No. 3,844,395. If the reverse movement of the paper web encounters appreciable resistance from a take-up device a printer malfunction is virtually certain, particularly when the printer uses the usual friction feed arrangement employing a roller platen.

Yet another difficulty relating to a printer paper take-up and storage device results from the fact that a variety of different width papers are used, even in the teleprinter field alone. To form tight rolls suitable for storage, a take-up device should afford accurate guidance for the paper edges. Thus, for many paper winders, there must be a separate model for each possible paper width.

In the operation of any web printer, the paper web ultimately runs out. Moreover, the paper web may break during recording. In either case, any paper take-up and storage device should function to wind up the paper web and then shut down to avoid overheating of the take-up drive motor. Connecting the new paper web to the take-up and storage device should be simple and convenient to minimize down-time for the printer.

SUMMARY OF THE INVENTION

It is an object of the invention, therefore, to provide a new and improved paper take-up and storage device for a printer that prints on a paper web, which effectively and inherently resolves the problems and difficulties discussed above.

Another object of the invention is to provide a new and improved paper take-up and storage device, for a printer recording on a paper web, that allows limited reverse movement of the web with minimal resistance and that combines paper length control and no-paper control in a simple, economical mechanism requiring a minimum of parts and presenting minimal possibilities of malfunction.

A specific object of the invention is to provide a new and improved take-up and storage device for a paper web printer that is rapidly and easily loaded with a fresh paper web and that is instantly adaptable to several different paper widths.

Accordingly, the invention relates to a paper take-up and storage device adapted for use with a printer of the kind employing a paper web as a record medium, the printer including a paper drive for advancing the record-bearing paper web out of the printer, and requiring the paper drive to effect a reverse movement of a limited length of the web back into the printer for a given printer operating condition. The take-up and storage device comprises a paper web storage reel, a reel drive motor for rotating the wheel, a control switch connected in an energizing circuit for the motor, a guide bail, extending transversely of the reel in position to engage the paper web ahead of the reel, the bail being pivotally movable from a home position into a range of deflected positions in response to take-up of the web onto the reel, bail bias means urging the bail toward its home position, and an actuator lever aligned with the bail and the control switch and pivotally movable from a take-up position, in which the actuator lever effectively actuates the control switch to energize the motor, to a range of inactive positions in which the actuator lever effectively actuates the control switch to de-energize the motor in response to positioning of the bail in its deflected position range. The improved construction of the invention comprises actuator bias means linking the actuator lever and the bail and biasing the switch actuator lever toward engagement with the bail for movement therewith, a paper presence sensor arm aligned with the actuator lever and positioned to engage the web adjacent the reel, the sensor arm being movable, by the web, from a no-paper position, in which it holds the actuator lever in its range of inactive positions independently of the position of the bail, to a paper-present position in which the sensor arm is effectively released from the actuator lever so that the lever follows the bail, and paper presence bias means biasing the sensor arm toward its no-paper position; essentially the only force opposing reverse movement of the web through said limited length is a limited bias force applied to the bail by the bail bias means.

BRIEF DESCRIPTION OF THE DRAWINGS

FIG. 1 is a side elevation view of a paper take-up and storage device incorporating one embodiment of the improved construction of the present invention;

FIG. 2 is a detail elevation view, similar to FIG. 1, illustrating a specific operating condition;

DESCRIPTION OF THE PREFERRED EMBODIMENT

FIGS. 1–4 illustrate a paper take-up and storage device 10, adapted for use with a printer of the kind employing a paper web as a record medium, that incorporates the improved construction of the present invention. The printer (not shown) typically includes a friction drive for advancing the paper web out of the printer during the recording process; the paper advance usually occurs in distinct line space increments, though some printers may advance the paper continuously during the printing operation. Further, the printer with which device 10 is used may require its paper drive to pull a limited length of the web back into the printer under given operating conditions, particularly at the end of a last-character visibility interval.

Figure 3:
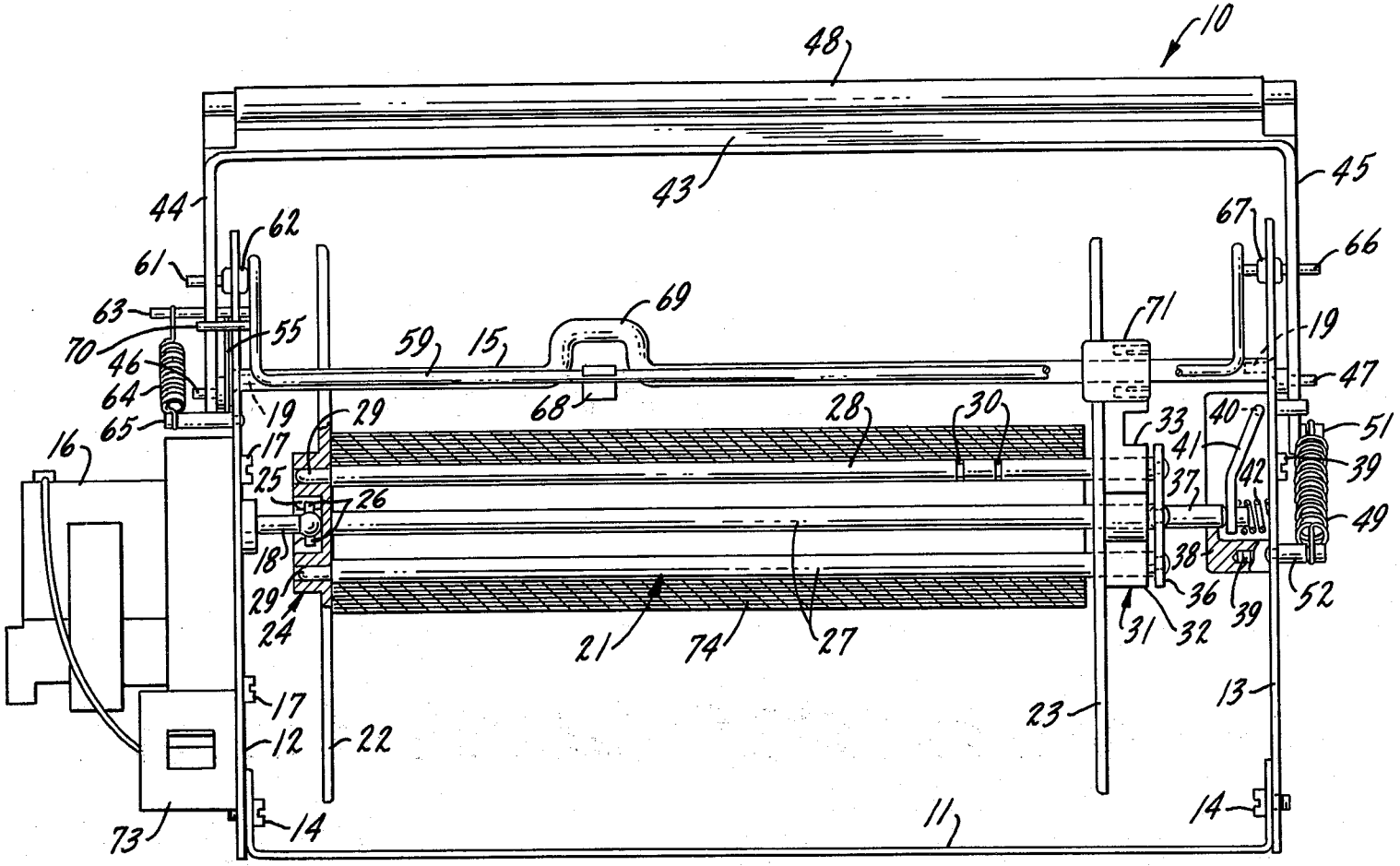
FIG. 3 is a front elevation view of the device of FIG. 1, with some parts in cross section.

Paper winder 10 comprises a base 11 on which two vertical frame members 12 and 13 are mounted by suitable means such as the screws 14 as shown in FIGS. 1 and 3. At the upper part of the frame 11—13, the spacing between the two frame members 12 and 13 is maintained by a transverse tie rod 15 secured to the frame members by suitable means such as the mounting screws 19. Tie rod 15 also constitutes a fixed paper guide as described more fully hereinafter.

A reel drive motor 16 is mounted on the outer side of the vertical frame member 12 by appropriate means such as the mounting bolts 17 (FIGS. 1 and 3). As shown, the reel drive motor 16 is a gear motor, although the particular form of moter employed is not critical to the present invention. However, drive motor 16 should afford substantial resistance to reverse movement, to maintain the integrity of a roll of paper stored in device 10, and, typically, may be equipped with a friction brake for this purpose. The shaft 18 of motor 16 extends through frame member 12 to afford a driving connection to a paper web storage reel 21 (FIG. 3).

Figure 5:
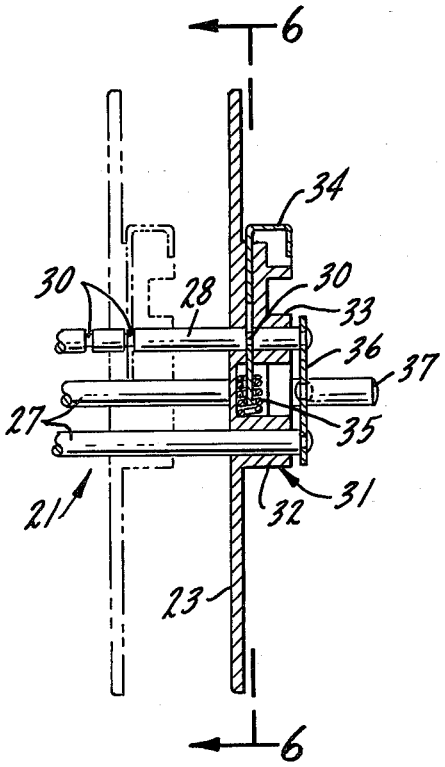
FIG. 5 is a detail sectional view of a part of the storage reel of the device of FIGS. 1–4.

Storage reel 21 comprises a disc 36, located at the right-hand end of the reel as seen in FIG. 3; three rods 27 and a fourth rod 28 are all securely fastened to disc 36 (FIGS. 3 and 5). Rod 28 is similar in construction to rods 27 except that it is provided with a plurality of spaced notches 30.

Storage reel 21 further includes two paper edge guide flange members 22 and 23 located adjacent the opposite sides of device 10 (FIG. 3). The guide flange 22, located adjacent the left-hand side of device 10 as seen in FIG. 3, includes an integral reel hub 24 in which two keyways 25 are formed. Keyways 25 receive two keys 26 on the outer end of motor shaft 18, completing a drive connection between the motor shaft and reel 21. The left-hand end of each of the rods 27,28 is of reduced diameter and is inserted into a socket 29 that is a part of hub 24.

Figure 6:
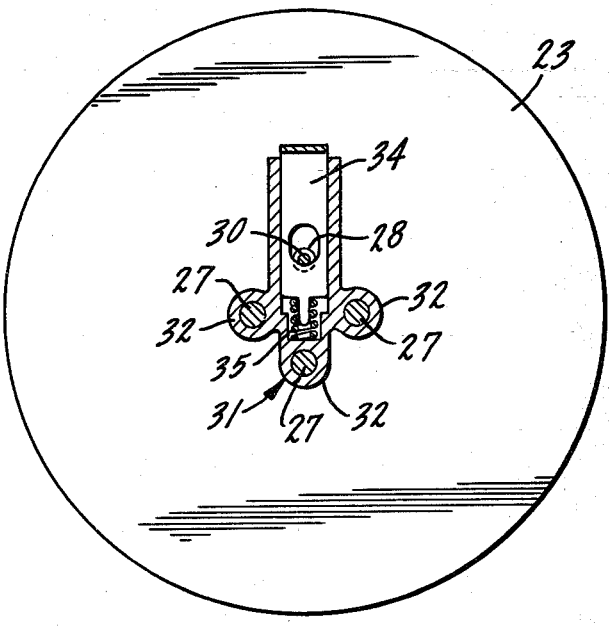
FIG. 6 is a detail sectional view taken approximately as indicated by line 6—6 in FIG. 5.

The construction employed at the right-hand end of reel 21 is best seen in FIGS. 3 and 5. As shown therein, a flange hub 31 is formed integrally with the right-hand paper edge guide flange member 23. Hub 31 includes a series of sockets 32 through which the rods 27 pass, and it also includes a socket 33 through which rod 28 extends. As shown in FIGS. 5 and 6, a keeper slide 34 is slidably mounted in hub 31 and engages in one of the notches 30 to secure the flange hub 31 in one of several predetermined positions on rods 28 and 27. A bias spring 35 normally maintains keeper 34 in engagement with the selected notch 30 in rod 28.

A short support shaft 37 is mounted on disc 36. Shaft 37 fits into a shaft receptacle 38 mounted on the vertical frame member 13 by suitable means such as the mounting screws 39. A retainer lever 41 is pivotally mounted within the shaft receptacle 38, the pivotal mount being indicated by reference numeral 40. A spring 42 biases the retainer lever 41 into engagement with the outer end of shaft 37 to maintain reel 21 mounted in frame 11–13 in driving connection with motor shaft 18.

Figure 4:
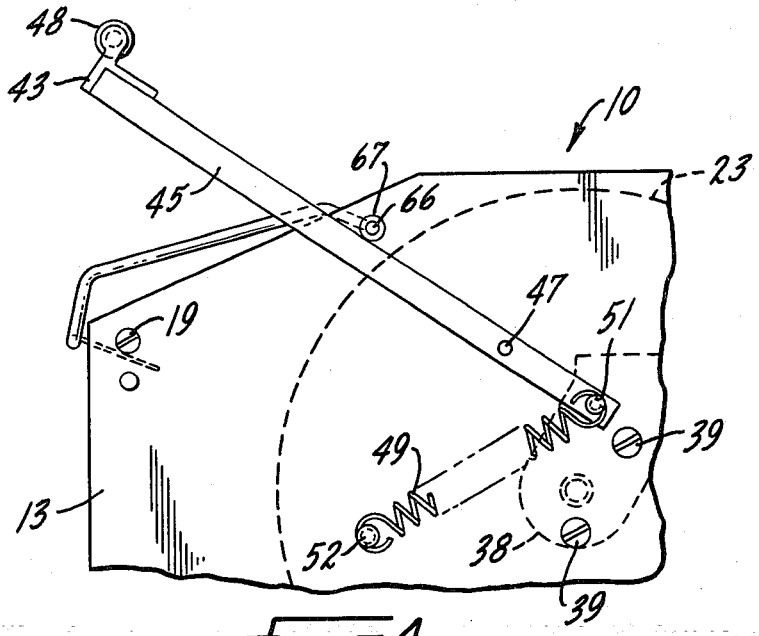
FIG. 4 is a detail side elevation view of the opposite side of the device from that shown in FIG. 1.

Device 10 further comprises a guide bail 43 as shown in FIGS. 1–4. One arm 44 of bail 43 is pivotally mounted upon a pivot pin 46 affixed to and projecting outwardly from the vertical frame member 12 (FIGS. 1–3). The opposite arm 45 of bail 43 (FIGS. 3 and 4) is pivotally mounted upon a pivot pin 47 affixed to and projecting outwardly from frame member 13. Bail 43 includes a guide roller 48 that extends transversely of device 10 in position to engage a paper web entering device 10 for storage on reel 21. Bail 43 is biased toward its home position, shown in solid lines in FIGS. 1–4, by a spring 49 connected at one end to a pin 51 on bail arm 45 and at the other end to a pin 52 affixed to vertical frame member 13 (FIG. 4). The bail bias spring 49 is preferably a relatively weak spring, for reasons set forth below.

A normally open control switch 53 is mounted on vertical frame member 12, as shown in FIGS. 1 and 2. Control switch 53 includes a switch arm 54 projecting upwardly into alignment with a switch actuator lever 55 that is pivotally mounted upon the bail arm pivot 46. Actuator lever 55 is of generally L-shaped configuration; the arm 55A of lever 55 that engages switch arm 54 is linked to the end of bail arm 44 by an actuator bias spring 56. The other arm of lever 55 includes two tabs 57 and 58. Tab 57 projects outwardly from lever 55 into alignment with the lower surface of bail arm 44. Tab 58, on the other hand, projects upwardly from the end of lever 55 into alignment with a horizontal projection 63 from a paper presence sensor arm 59.

The paper presence sensor arm 59, in the illustrated construction, constitutes a bail that extends across device 10 adjacent to the transverse tie rod and paper guide 15. The left-hand end of sensor arm 59, as seen in FIG. 3, includes a pivot pin 61 journalled in a bearing 62 mounted in the vertical frame member 12. The construction at the right-hand end of sensor arm 15 is similar, comprising a pivot pin 66 journalled in a bearing 67 mounted in the other vertical frame member 13 (FIGS. 3 and 4). A paper presence bias means is provided for sensor arm 59; in the illustrated construction, this bias means comprises a spring 64 connected from pin 63 to a pin 65 mounted on vertical frame member 12 (FIGS. 1–3). Sensor arm 59 further comprises a tab 68 extending from the central portion of the sensor arm in alignment with a step recess 69 in the fixed paper guide, tie rod 15. A short rod or finger 70 affixed to sensor arm 59 projects outwardly below bail arm 44 (FIGS. 1–3).

When the paper take-up and storage device 10 is set up for operation with a given printer, one preliminary requirement is adjustment of the position of flange 23 to correspond to the width of the paper web used by the printer. This is accomplished simply and conveniently by depressing keeper slide 34 (FIGS. 5 and 6) to release the slide from engagement with any of the notches 30 in rod 28. With the keeper slide 34 depressed, flange 23 and its hub 31 can be shifted into alignment with any of the notches 30, thus accommodating device 10 to use with any of several standard widths of a paper web 72. When slide 34 is aligned with the appropriate notch 30, it is released and thereafter maintains guide flange 23 in the desired position. Device 10 may also include a friction loaded paper edge guide 71 mounted on tie rod 15 as shown in FIG. 3. If guide 71 is present, it is usually adjusted to a position just inside the inner edge of flange 23 to hold the paper web against the other flange 22, thereby assuring tight winding of a roll of paper 74 on reel 21.

Assuming that reel 21 is properly adjusted for the appropriate paper web width, the next step in the utilization of device 10 is the connection of a paper web 72 to storage reel 21. Before the paper web 72 is connected to device 10, the guide bail 43, switch actuator lever 55, and paper sensing arm 59 are in the position shown in FIG. 2. That is, the paper presence sensor arm 59 is pivoted to its no-paper position, as shown in FIG. 2, by the operation of its bias spring 64, with the paper sensor tab 68 engaged in recess 69 in tie rod 15. With the paper presence sensor arm 59 in this position, its projection 63 bears downwardly on the tab 58 at the end of the switch actuator lever 55. In this manner, the paper presence sensor arm 59, when in its no-paper position (FIG. 2) holds the switch actuator lever 55 in an inactive position, free of arm 54 of control switch 53. Under these circumstances, switch 53 is open and the reel drive motor 16 cannot be energized.

The next step in the utilization of device 10 is to thread a paper web 72 into the device and into storage reel 21. When this is to be done, a main switch 73 connected in series with control switch 53 is opened in order to preclude premature energization of drive motor 16. Bail 43 is then pivoted downwardly, engaging finger 70 so that the paper sensor arm 59 is depressed to a level at which tab 68 is appreciably below tie rod 15, clear of the tie rod recess 69. With bail 43 and arm 59 thus lowered, a paper web 72 is first pulled over roller 48 on bail 43 and the end of the paper web is directed between the paper sensor arm 59 and the fixed paper guide comprising tie rod 15. When bail 43 and sensor arm 59 are subsequently released, arm 59 cannot return to its original position because tab 68 now engages paper web 72 and cannot enter recess 69 in tie rod 15. Thus, the paper web holds sensor arm 59 in the paper-present position shown in FIGS. 1 and 3. From this point, web 72 is pulled further into device 10 and is threaded between any two of the rods 27 and 28 to establish a connection to reel 21. Connecting the paper web into device 10 is appreciably simplified and facilitated by the joint manual actuation of bail 43 and arm 59, made possible by the finger 70.

With the paper web 72 connected to reel 21 the displacement of paper presence sensor arm 59 caused by engagement of its tab 68 with the paper web maintains projection 63 in the elevated position of FIG. 1. For these conditions, spring 56 holds the switch actuator lever 55 with its tab 57 engaged with the bottom surface of bail arm 44. As long as paper is present in device 10, therefore, actuator lever 55 moves as one with bail arm 44.

For purposes of explanation, at this juncture it may be assumed that there is appreciable slack in paper web 72 so that bail 43 is in its uppermost or home position, being biased to that position by spring 49 (FIG. 4). As a consequence, the switch actuator lever 55 is in engagement with switch arm 54 and control switch 53 is closed. Accordingly, when main switch 73 is closed, motor 16 is energized and rotates its shaft 18 in a counterclockwise direction (FIG. 1), winding a portion of web 72 onto reel 21 to begin the formation of the paper storage roll 74. As the paper web 72 is wound onto reel 21, the web ultimately becomes taut and starts to pull downwardly on bail 43 against the quite limited bias force afforded by spring 49. The downward movement of bail 43 pivots bail arm 44 in a clockwise direction about its pivot pin 46 and the switch actuator lever 55 follows this movement. After a short pivotal movement of bail arm 44 and actuator lever 55, the actuator lever is freed from engagement with arm 54 of control switch 53 and the control switch opens, de-energizing the reel drive motor 16.

With motor 16 de-energized, the motor and reel 21 stop rotation after a brief coasting movement due to inertia of the rotating parts. Motor 16 should have sufficient braking action to preclude any reverse "bounce" of reel 21. Bail 43 ends up on the deflected position indicated by phantom outline 43A in FIG. 1. Position 43A is the end of a substantial range of deflected operating positions displaced from the home position shown in solid lines in the drawing. As will be apparent from the foregoing description, as long as bail 43 is in a deflected position, with paper present in device 10, switch actuator lever 55 is held in one of its inactive positions (e.g., position 55A) in which control switch 53 is open and motor 16 is de-energized.

The paper take-up and storage device 10 is now ready for normal operation. As information is recorded on paper web 72, the printer (not shown) that is the source of the paper web advances the paper, usually in line space increments, as indicated by arrow A (FIG. 1). At first, the only effect on device 10 is that bail 43 moves upwardly to another deflected position, intermediate position 43A and the home position. Ultimately, however, enough of the paper web 72 is fed toward device 10 so that bail 43, responsive to the limited bias force applied by spring 49, returns to its fully elevated home position. When this happens, switch actuator lever 55, which is moving conjointly with bail arm 44, returns to its take-up position, FIG. 1, engages arm 54, and closes control switch 53. This again energizes the reel drive motor 16 to rotate reel 21 and wind more of the paper web 72 onto roll 74 on reel 21. As before, this take-up operation results in deflection of bail 43 approximately to the position 43A and again de-energizes motor 16.

When paper web 72 is exhausted, or in the event of a break in the paper web, there is no restraining force on bail 43 and the bail is moved back to its position of maximum elevation, its home position, by spring 49. In consequence, regardless of the previous operating condition of device 10, motor 16 is energized and winds up the remainder of paper web 72 on reel 21. When the end of web 72 moves past the fixed paper guide 15, tab 68 on the paper presence sensor arm 59 is released to move upwardly into recess 69 in guide 15. In consequence, spring 64 pivots the paper sensor arm 59 back to its no-paper position as shown in FIG. 2; in returning to the no-paper position, the projection 63 on arm 59 deflects switch actuator lever 55 back to its inactive position, away from switch arm 54, so that control switch 53 is effectively actuated to de-energize motor 16. Accordingly, motor 16 is protected against continuing operation with no paper present, which could be harmful to the motor if maintained for an extended period.

It is a relatively simple matter for an operator to remove reel 21 from device 10 by pulling the reel shaft 37 upwardly out of receptacle 38. To remove paper roll 74 from reel 21, flange 22 is displaced from the ends of rods 27 and 28 and the paper roll is pulled off of the rods. The guide flange 22 is then re-installed on rods 27 and 28 and reel 21 is replaced in device 10 ready for further operation.

From the foregoing description, it will be seen that the switch actuator lever 55, being aligned with both bail 43 and paper presence sensor arm 59, provides two distinct control functions through its actuation of control switch 53. In normal operation, this one switch actuator lever follows the movements of arm 44 of bail 43, energizing motor 16 only when necessary to take up paper web 72. On the other hand, in the event of any termination of paper web 72, whether by a break in the paper web or exhaustion of the paper supply to the printer, actuator lever 55 maintains motor 16 continuously energized until the paper is all wound on roll 74 and then de-energizes the motor in response to the resultant movement of paper sensor arm 59 to its no-paper position.

In normal operation of device 10, throughout the range of movements for bail 43, essentially the only force opposing reverse movement of paper web 72, for a limited length of the paper web, is the bias force applied to guide bail 43 by spring 49. Thus, spring 56 functions only to cause lever 55 to follow bail arm 44; it has no effect on movement of bail 43 or on web 72. Spring 64 acts only on sensor arm 59, which applies no appreciable drag to the paper. Furthermore, any friction drag from fixed guide 15, or from tab 68 of arm 59, occurs after the paper has passed over roller 48 on bail 43 and does not impede the limited reverse paper movement needed for last-character visibility operation. Moreover, there is always enough paper between roller 48 and guide 15 to allow appreciable reverse movement of the paper without pulling paper from roll 74 against the drag of motor 16.

Spring 49 is preferably a relatively weak spring. Consequently, when device 10 is used with a printer that provides last-character-visibility by advancing the paper web a few line increments out of the printer, and requires a corresponding reverse movement of the web back into the printer when printing is resumed, device 10 does not inhibit or interfere with the required reverse movement. That is, any ordinary roller platen or other friction feed in the printer can effect the necessary reverse movement of web 72. Consequently, device 10 can be employed with virtually any printer, using a variety of different standard widths of paper, with maximum convenience and effectiveness despite the extreme simplicity and economical construction of the device. As described, control switch 53 is a normally-open switch. It will be recognized, however, that a normally-closed switch can be used for the control function, with appropriate revision of the relationship of the control switch to the other members of device 10, particularly as regards the switch actuator lever 55.

We claim:

1. In a paper take-up and storage device adapted for use with a printer of the kind employing a paper web as a record medium, the printer including a paper drive for advancing the record-bearing paper web out of the printer, and requiring the paper drive to effect a reverse movement of a limited length of the web back into the printer for a given printer operating condition, the take-up and storage device comprising:

a paper web storage reel;

a reel drive motor for rotating the reel;

a control switch connected in an energizing circuit for the motor;

a guide bail, extending transversely of the reel in position to engage the paper web ahead of the reel, the bail being pivotally movable from a home position into a range of deflected positions in response to take-up of the web onto the reel;

bail bias means urging the bail towards its home position;

and an actuator lever aligned with the bail and the control switch and pivotally movable from a take-up position, in which the actuator lever effectively actuates the control switch to energize the motor, to a range of inactive positions in which the actuator lever effectively actuates the control switch to de-energize the motor in response to positioning of the bail in its deflected position range;

the improved construction comprising:

actuator bias means linking the actuator lever and the bail and biasing the switch actuator lever toward engagement with the bail for movement therewith;

a paper presence sensor arm aligned with the actuator lever and positioned to engage the web adjacent the reel, the presence sensor arm being movable, by the web, from a no-paper position, in which it holds the actuator lever in its range of inactive positions independently of the position of the bail, to a paper-present position in which the sensor arm is effectively released from the actuator lever so that the lever follows the bail;

and paper presence bias means biasing the presence sensor arm toward its no-paper position;

essentially the only force opposing reverse movement of the web through said limited length being a limited bias force applied to the bail by the bail bias means.

2. A paper take-up and storage device for a printer, according to claim 1, in which the actuator lever and the bail are pivotally movable about the same axis and in which the actuator bias means comprises a spring interconnecting the switch actuator and one arm of the bail.

3. A paper take-up and storage device for a printer, according to claim 1, and further comprising a fixed paper guide, having a small recess therein, extending transversely of the web and engaging the web at a location intermediate the bail and the reel, in which the paper presence sensor arm extends transversely of the reel adjacent the fixed paper guide and includes a sensor tab aligned with the recess in the fixed paper guide, the sensor tab extending into that recess when the paper presence sensor arm is in its no-paper position and being held out of that recess by the paper web, when present, to maintain the sensor arm in its paper-present position.

4. A paper take-up and storage device for a printer, according to claim 1, in which a portion of the sensor arm projects into the path of the guide bail in position to be engaged by the bail such that movement of the bail to an extreme deflected position moves the sensor arm beyond its paper-present position to facilitate connection of a paper web into the device.

5. A paper take-up and storage device for a printer, according to claim 1, claim 2, claim 3, or claim 4, in which the control switch is a normally-open switch and in which the actuator lever, when in its take-up position, engages the control switch to close the switch, and in which the actuator lever is disengaged from the control switch when in its range of inactive positions.

6. A paper take-up and storage device for a printer, according to claim 1, claim 2, claim 3, or claim 4, in which the reel comprises:

a plurality of rods anchored to and extending from a disc, one of the rods having a series of spaced notches therein adjacent the disc;

a first paper edge guide flange, including a first flange hub, mounted on the outer ends of the rods;

a second paper edge guide flange, including a second flange hub, slidably mounted on the rods;

and a spring biased keeper slide, mounted on the second flange hub and engageable in any one of the notches in the one rod, for maintaining the second guide flange at any one of a series of predetermined spacings from the first guide flange to accommodate paper webs of different widths.

7. A paper take-up and storage device for a printer, according to claim 6, in which the rods are received in sockets in the first flange hub, permitting disassembly of the reel by displacing the first guide flange from the ends of the rods.

* * * * *